US009689579B2

(12) United States Patent
Jung et al.

(10) Patent No.: US 9,689,579 B2
(45) Date of Patent: Jun. 27, 2017

(54) DEHUMIDIFIER

(71) Applicant: SAMSUNG ELECTRONICS CO., LTD., Suwon-si, Gyeonggi-do (KR)

(72) Inventors: Hee Soo Jung, Suwon-si (KR); Seong Ryeol Myeong, Paju-si (KR); Je Woo Bang, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 262 days.

(21) Appl. No.: 14/482,212

(22) Filed: Sep. 10, 2014

(65) Prior Publication Data

US 2015/0192312 A1 Jul. 9, 2015

(30) Foreign Application Priority Data

Jan. 6, 2014 (KR) ..... 10-2014-0001244

(51) Int. Cl.
*F24F 3/14* (2006.01)
*F25D 21/14* (2006.01)
*F24F 13/22* (2006.01)

(52) U.S. Cl.
CPC ..... *F24F 3/1405* (2013.01); *F24F 13/222* (2013.01); *F24F 2003/1446* (2013.01)

(58) Field of Classification Search
CPC ..... F24F 3/1405; F24F 2003/1446; F24F 13/222; F24F 2001/0085; F24F 3/14; F24F 2003/144; F24F 2006/008; F24F 3/153; F25D 21/14
USPC ..... 62/291
See application file for complete search history.

(56) References Cited

U.S. PATENT DOCUMENTS 4,712,382 A * 12/1987 LeClear ..... F24F 3/1405 141/198
5,555,732 A * 9/1996 Whiticar ..... F24F 3/14 62/3.4
5,884,495 A * 3/1999 Powell ..... F24F 1/02 200/61.07
7,856,840 B2 * 12/2010 Yoon ..... B01D 53/06 62/285
8,097,073 B2 * 1/2012 Jang ..... F24F 3/14 62/150
2002/0023445 A1 * 2/2002 Sul ..... F24F 3/153 62/188
2006/0278085 A1 * 12/2006 Kim ..... B01D 53/261 96/140
2006/0283327 A1 * 12/2006 Yoon ..... B01D 53/06 96/143

(Continued)

*Primary Examiner* — Mohammad M Ali
(74) *Attorney, Agent, or Firm* — Staas & Halsey LLP

(57) ABSTRACT

A dehumidifier includes an improved structure of a water tank in order to enhance convenience in use of the water tank. The dehumidifier includes: a main body to form an external appearance of the dehumidifier, and including an air entrance and an air exit; a heat exchanger in which refrigerant to exchange heat with air coming through the air entrance circulates; and a water tank configured to store condensed water formed when the air come through the air entrance exchanges heat with the refrigerant, wherein the water tank includes: a storage space formed in the water tank to store the condensed water, and a handle coupled to the water tank at one side of the water tank, and inclined toward the other side of the water tank.

27 Claims, 11 Drawing Sheets

(56) References Cited

U.S. PATENT DOCUMENTS

| | | | | |
|---|---|---|---|---|
| 2007/0062370 | A1* | 3/2007 | Ahn | F24F 3/1423 95/115 |
| 2010/0071399 | A1* | 3/2010 | Yoon | F24F 3/153 62/291 |
| 2011/0167670 | A1* | 7/2011 | Stamm | F04D 25/08 34/491 |
| 2011/0247352 | A1* | 10/2011 | Zanolin | F24F 3/14 62/263 |
| 2013/0055735 | A1* | 3/2013 | DeMonte | F24F 1/04 62/89 |

* cited by examiner

DEHUMIDIFIER

CROSS-REFERENCE TO RELATED APPLICATIONS

This application claims the benefit of Korean Patent Application No. 10-2014-0001244, filed on Jan. 6, 2014 in the Korean Intellectual Property Office, the disclosure of which is incorporated herein by reference.

BACKGROUND

1. Field

Embodiments of the present disclosure relate to a dehumidifier, and more particularly, to a dehumidifier with an improved structure of a water tank in order to enhance convenience in use of the water tank.

2. Description of the Related Art

In general, a dehumidifier is an apparatus for to intake humid air in the indoor space, to pass the air through a heat exchanger including a condenser through which refrigerant circulates and an evaporator to lower the humidity of the air, and then to reintroduce the dehumidified air to the indoor space, thereby lowering the humidity of the indoor space.

That is, the dehumidifier evaporates refrigerant in the liquid state in the evaporator to take away heat from the ambient air. Then, when the refrigerant is evaporated, the temperature of the evaporator is reduced so that air passing through the evaporator is cooled accordingly.

Accordingly, the temperature around the evaporator gets lower so that moisture included in the air is condensed to form dewdrops on the surface of the evaporator.

A water tank for storing condensed water formed on the surface of the evaporator may be provided inside the dehumidifier. The water tank may include a handle for conveniently moving the water tank.

However, if the handle is installed in the water tank, a storage capacity of condensed water may be reduced. Furthermore, the internal structure of the water tank becomes complicated, which makes cleaning the water tank and maintaining cleanliness of the water tank difficult. In order to overcome the problem, a handle is desired to be attached to the outside of the water tank. However, in this case, when the water tank is separated and moved from the dehumidifier, the water tank may be inclined so that condensed water spills out of the water tank.

SUMMARY

Additional aspects and/or advantages will be set forth in part in the description which follows and, in part, will be apparent from the description, or may be learned by practice of the invention.

Therefore, it is an aspect of the present disclosure to provide a dehumidifier with an improved structure of a water tank including a wide storage space for condensed water.

It is another aspect of the present disclosure to provide a dehumidifier with a simplified internal structure of a water tank so that the water tank can be easily cleaned to maintain its cleanliness.

It is still another aspect of the present disclosure to provide a dehumidifier with an improved structure of a water tank in order to prevent condensed water stored in the water tank from spilling out of the water tank when the water tank is moved.

Additional aspects of the disclosure will be set forth in part in the description which follows and, in part, will be obvious from the description, or may be learned by practice of the disclosure.

In accordance with one aspect of the present disclosure, a dehumidifier includes: a main body to form an external appearance of the dehumidifier, and including an air entrance and an air exit; a heat exchanger in which refrigerant to exchange heat with air coming through the air entrance circulates; and a water tank configured to store condensed water formed when the air come through the air entrance exchanges heat with the refrigerant, wherein the water tank includes: a storage space formed in the water tank to store the condensed water, and a handle coupled to the water tank at one side of the water tank, and inclined toward the other side of the water tank.

The handle may be coupled to an outer part of the water tank.

The water tank may be coupled to the main body to face a first direction, and the handle may be inclined upward in the first direction with respect to the water tank.

The main body may include: a first panel to form an external appearance of the dehumidifier facing the first direction, together with the water tank; a second panel including the air entrance, and facing a second direction, wherein a frame may be disposed between the first panel and the second panel, and the water tank may be coupled to the frame to face the first direction.

The water tank may be detachably coupled to the frame.

The main body may further include a third panel coupled to an upper portion of the frame, and including the air exit, wherein the third panel may be coupled to a discharge louver configured to open or close the air exit.

The frame may include a water tank resting portion exposed to the outside to face the first direction such that the water tank is coupled to the water tank resting portion.

The heat exchanger may be disposed in the interior of the second panel, and the frame may further include a plate positioned over the water tank resting portion such that the heat exchanger is mounted on the plate.

A water passageway configured to guide the condensed water formed on the heat exchanger to the storage space may be formed on the plate.

An inlet opening configured to cause the condensed water moving along the water passageway to be collected in the storage space may be formed in a part of the water tank facing the plate.

The handle may be coupled to a handle coupling portion of the water tank facing the water tank resting portion such that the handle slides in a up-down direction.

One or more guides extending in the up-down direction may be formed on the handle coupling portion, and the guides may be protruded in the second direction.

A protrusion height of each guide may be lower at an upper portion of the guide.

The handle may include: a holding unit configured to be grippable by a user; and one or more supporting units connected to the holding unit, and configured to slide in the up-down direction along the guides.

On each supporting unit, a stopper may be protruded in the first direction, and the stopper may be caught by a catch element formed on an upper end of the corresponding guide in order to prevent the supporting unit from being separated from the guide from an upper portion of the supporting unit.

The handle coupling portion may have a curved surface which is convex in the first direction.

In accordance with another aspect of the present disclosure, a dehumidifier includes: a main body including an air entrance and an air exit; a blowing fan installed in the main body, and configured to blow air coming through the air entrance in a first direction to the air exit; a heat exchanger configured to exchange heat with air entered the main body by the blowing fan; and a water tank configured to store condensed water formed by the heat exchanger during heat-exchange, and to form an external appearance of the dehumidifier facing the first direction, together with the main body, wherein a handle is coupled to the water tank in such a manner to be inclined upward in the first direction with respect to the water tank.

The handle may be coupled to an outer part of the water tank in such a manner to rotate with respect to the outer part of the water tank.

The handle may be coupled to an outer part of the water tank in such a manner to slide in a up-down direction with respect to the outer part of the water tank.

The main body may include: a first panel positioned in a up-down direction with respect to the water tank to face the first direction; a second panel including the air entrance, and facing a second direction that is opposite to the first direction, wherein a frame is disposed between the first panel and the second panel, and the water tank is detachably coupled to the frame.

The frame may include: a water tank resting portion with which a handle coupling portion of the water tank including a curved surface which is convex in the first direction is coupled; a blowing fan resting portion located in a up-down direction with respect to the water tank resting portion, and coupled to the blowing fan; and a plate disposed between the water tank resting portion and the blowing fan resting portion such that the heat exchanger disposed in the interior of the second panel is mounted on the plate.

A water passageway configured to guide the condensed water to the interior of the water tank in order to store the condensed water in the water tank may be formed on the plate.

A plurality of guides extending in a up-down direction may be protruded in the second direction on the handle coupling portion, the plurality of guides may be spaced away from each other, and a protrusion height of each guide may be higher at a lower portion of the guide.

The handle may include: a plurality of supporting units configured to slide in a up-down direction along the plurality of guides; and a holding unit connecting the plurality of supporting units to each other, and configured to be grippable by a user.

A cover may be attached to the handle coupling portion to face the water tank resting portion, and the cover may be coupled to the plurality of guides to form a plurality of engaging holes through which the plurality of supporting units pass to slide in the up-down direction.

The holding unit may be caught by an upper plate of the cover in order to prevent the plurality of supporting units from being separated from the plurality of guides from lower portions of the supporting units.

In accordance with another aspect of the present disclosure, a dehumidifier includes: a main body including an air entrance and an air exit; and a water tank configured to store moisture in air entering the main body, and coupled to the main body to form an external appearance of the dehumidifier, wherein a handle is coupled to an outer part of the water tank in such a manner to be inclined with respect to the outer part of the water tank.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
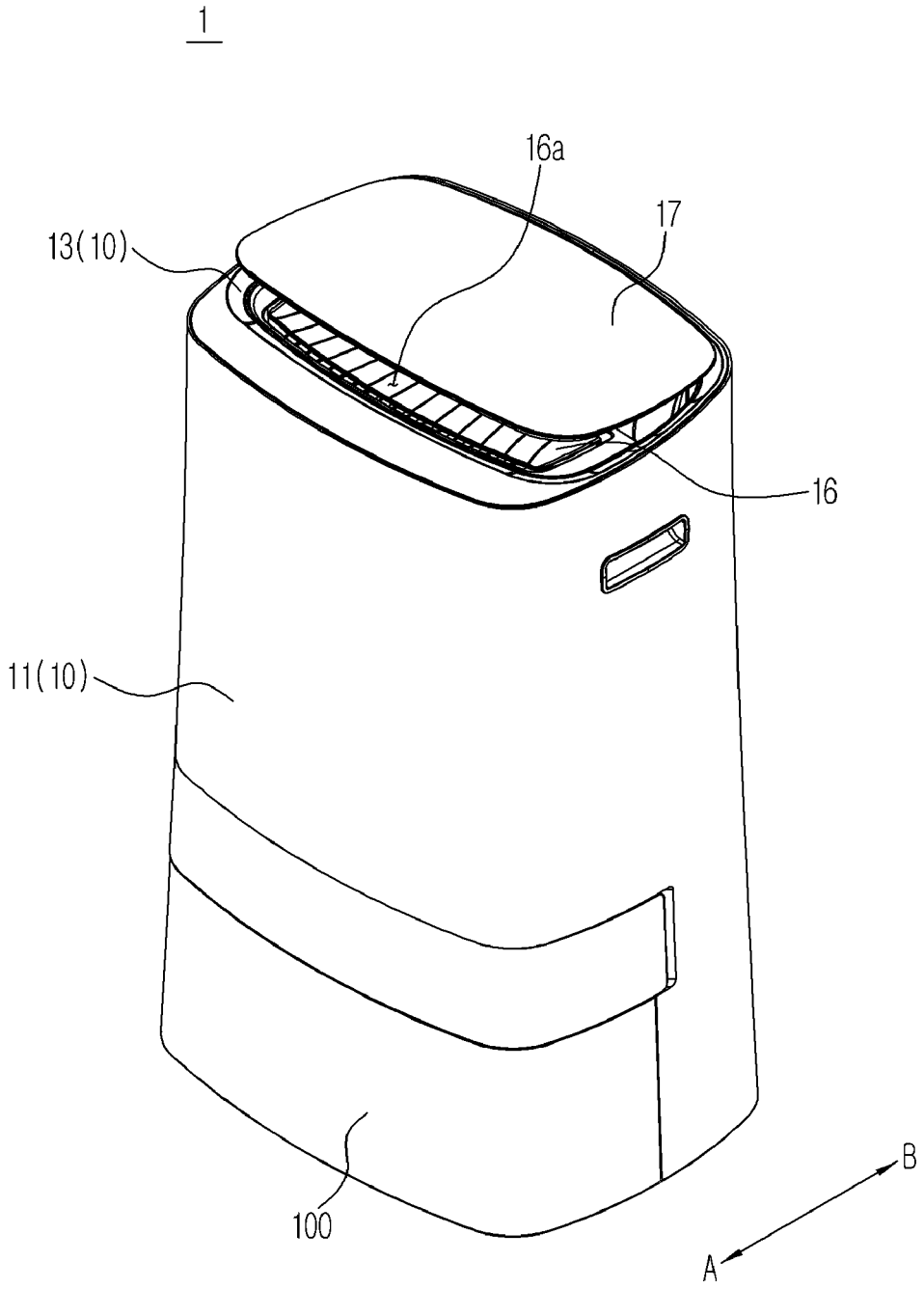
FIG. 1 is a perspective view showing a front part of a dehumidifier according to an embodiment of the present disclosure.

Reference will now be made in detail to the embodiments, examples of which are illustrated in the accompanying drawings, wherein like reference numerals refer to the like elements throughout. The embodiments are described below to explain the present invention by referring to the figures.

Hereinafter, embodiments of the present disclosure will be described in detail with reference to the appended drawings. In the following description, the terms "front end", "rear end", "upper portion", "lower portion", "upper end", and "lower end" are defined based on the drawings, and the shapes and positions of the corresponding components are not limited by the terms.

Figure 2:
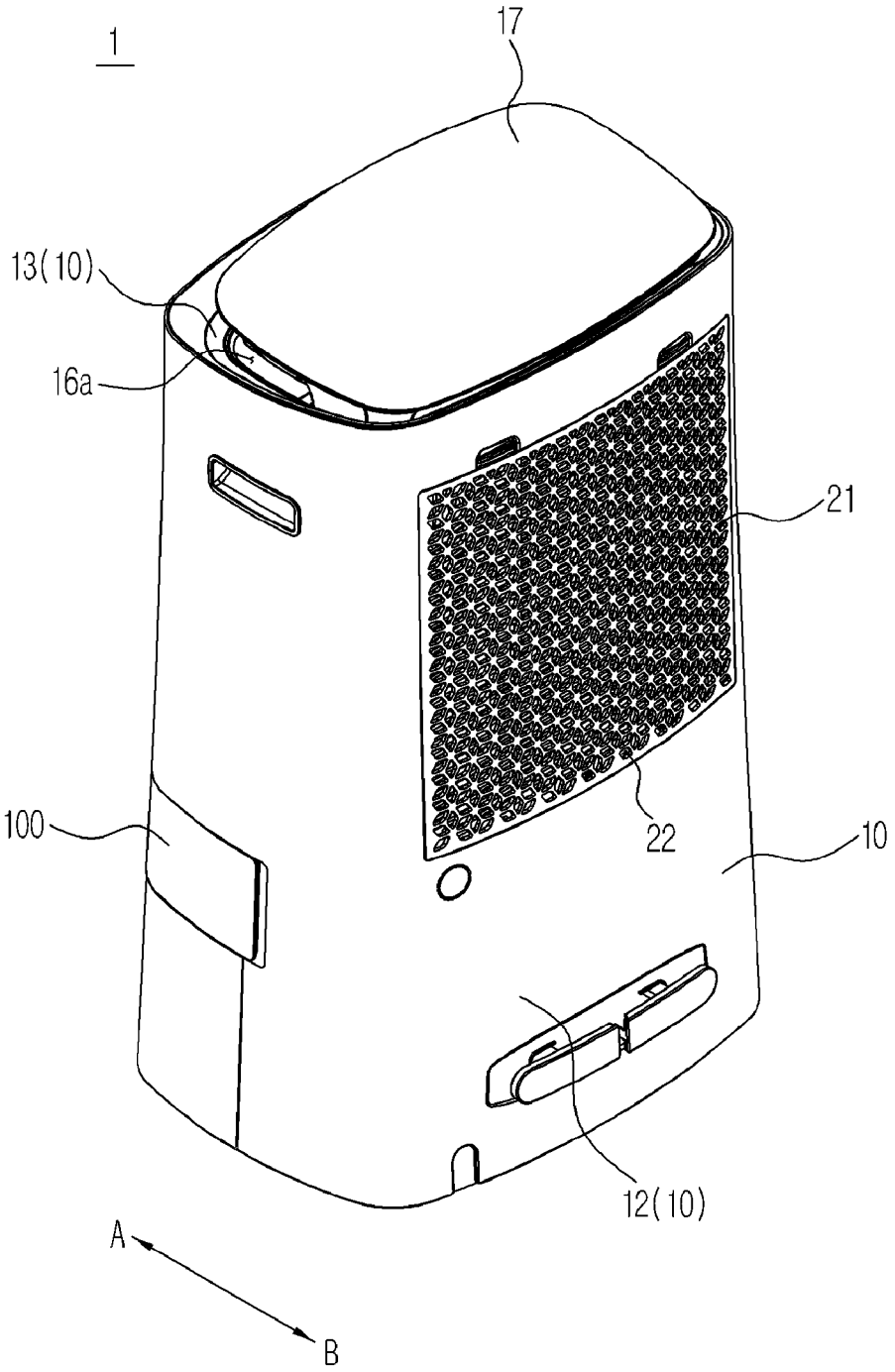
FIG. 2 is a perspective view showing a rear part of a dehumidifier according to an embodiment of the present disclosure.

FIG. 1 is a perspective view showing a front part of a dehumidifier according to an embodiment of the present disclosure, and FIG. 2 is a perspective view showing a rear part of a dehumidifier according to an embodiment of the present disclosure. Hereinafter, for convenience of description, a first direction A is forward, and a second direction B is backward. In addition, the first direction may be substantially opposite the second direction.

As shown in FIGS. 1 and 2, a dehumidifier 1 may include a main body 10 to form an external appearance of the dehumidifier 1.

The main body 10 may include a first panel 11 facing the first direction A, and a second panel 12 facing the second direction B. The first panel 11 and the second panel 12 may be detachably coupled to each other to form the main body 10.

On the first panel 11 may be provided a display unit (not shown) to display the operating state of the dehumidifier 1. Also, on the first panel 11 may be provided one or more manipulation buttons for controlling the operating state of the dehumidifier 1, which will be displayed on the display unit. However, the display unit and the manipulation buttons may be provided at another location than the first panel 11.

A water tank 100 may be disposed to face the first direction A, and form the external appearance of the dehumidifier 1 together with the first panel 11. The water tank 100 may be positioned below the first panel 11, and the position relationship between the water tank 100 and the first panel 11 is not limited to this.

Figure 5:
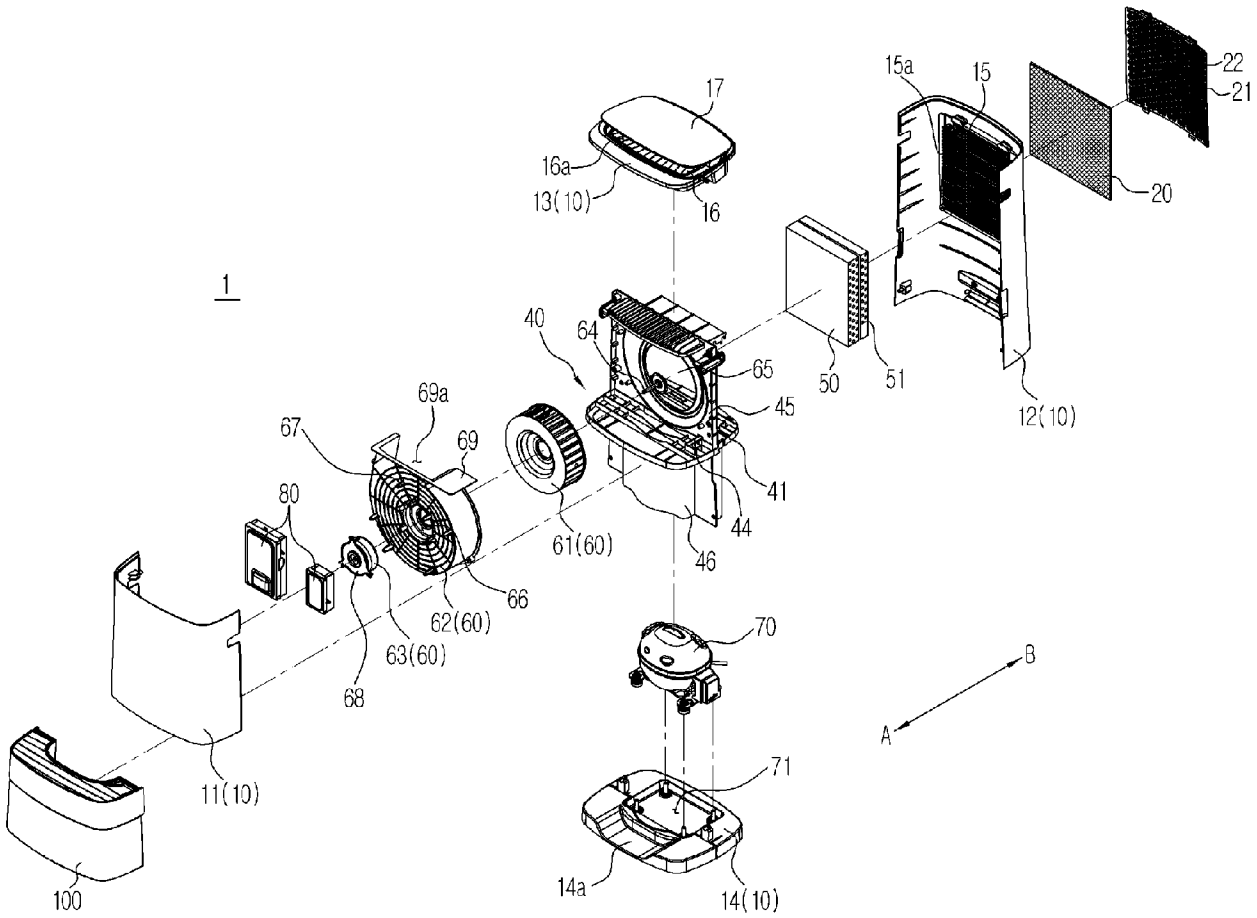
FIG. 5 is an exploded perspective view of a dehumidifier according to an embodiment of the present disclosure.

The second panel 12 may include an air entrance grille 15*a* (see FIG. 5) to form an air entrance 15*a* (see FIG. 5). On the second panel 12 may be provided a filter 20 (see FIG. 5) for cleaning air entering the main body 10 through the air entrance 15*a*. The filter 20 may function to filter out foreign materials in the air entering the main body 10, and the filter 20 may have a size corresponding to the air entrance grille 15. The filter 20 may be fixed on the second panel 12 by a filter cover 21 that is coupled to the second panel 12 in the outer side of the filter 20, so that the filter 20 faces the air entrance grille 15. The filter cover 21 may be detachably coupled to the second panel 12 so that the filter 20 can be easily replaced by a new one.

In the filter cover 21, a plurality of holes 22 may be formed. Air coming through the holes 22 may flow to the interior of the main body 10 via the filter 20 and the air entrance 15*a*.

The filter 20 may include at least one of a prefilter to remove relatively large particles in the air, a deodorizing filter for deodorization, a dust collecting filter to collect particles through electrical actions, and a High Efficiency Particular Air (HEPA) filter to remove fine particles.

The filter 20 may be attached on the inner side of the second panel 12.

The main body 10 may further include a third panel 13 that is mounted on the upper ends of the first and second panels 11 and 12. The third panel 13 may be coupled to the first and second panels 11 and 12 to form the external appearance of the dehumidifier 1.

In the third panel 13, a discharge grille 16 that forms an air exit 16*a* may be provided. Air entering the main body 10 through the air entrance 15*a* may be discharged to the outside through the air exit 16*a*.

The air exit 16*a* may be opened or closed by a discharge louver 17 that is coupled to the third panel 13. When the dehumidifier 1 operates by manipulating the manipulation buttons, the discharge louver 17 may move upward to open the air exit 16*a*. Thereafter, if the dehumidifier 1 stops operating, the discharge louver 17 may move downward to close the air exit 16*a*. Accordingly, the dehumidifier 1 may be prevented from wrongly operating due to foreign materials that came in the interior of the main body 10.

The main body 10 may further include a fourth panel 14 (see FIG. 3) that is disposed in the lower ends of the first and second panels 11 and 12. The fourth panel 14 may be combined with the first and second panels 11 and 12 and the third panel 13 to form the external appearance of the dehumidifier 1.

The fourth panel 14 may include a plurality of wheels 30 (see FIG. 11) to move the dehumidifier 1.

Figure 3:
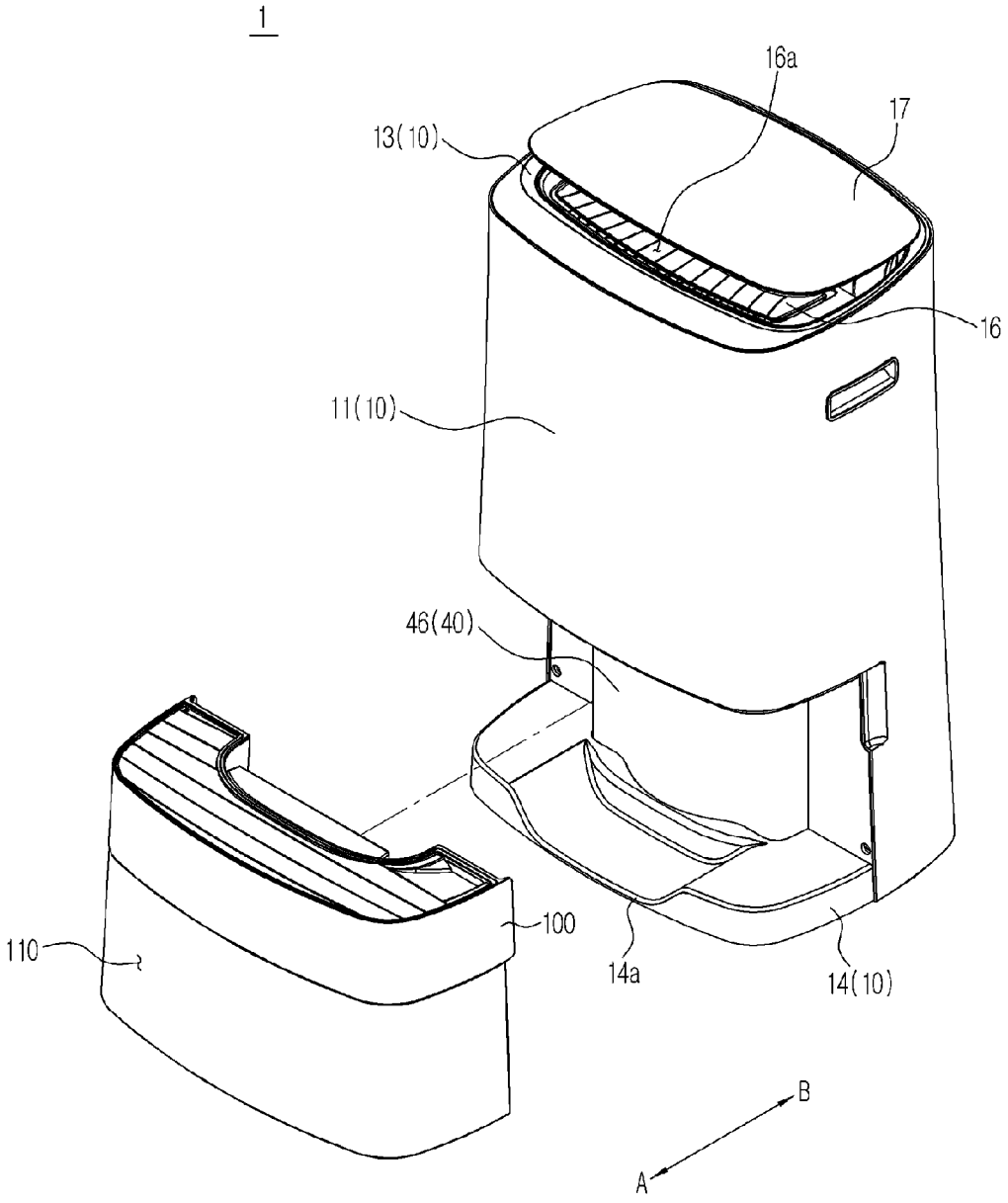
FIG. 3 is a perspective view showing a front part of a dehumidifier according to an embodiment of the present disclosure when a water tank is drawn out.
Figure 4:
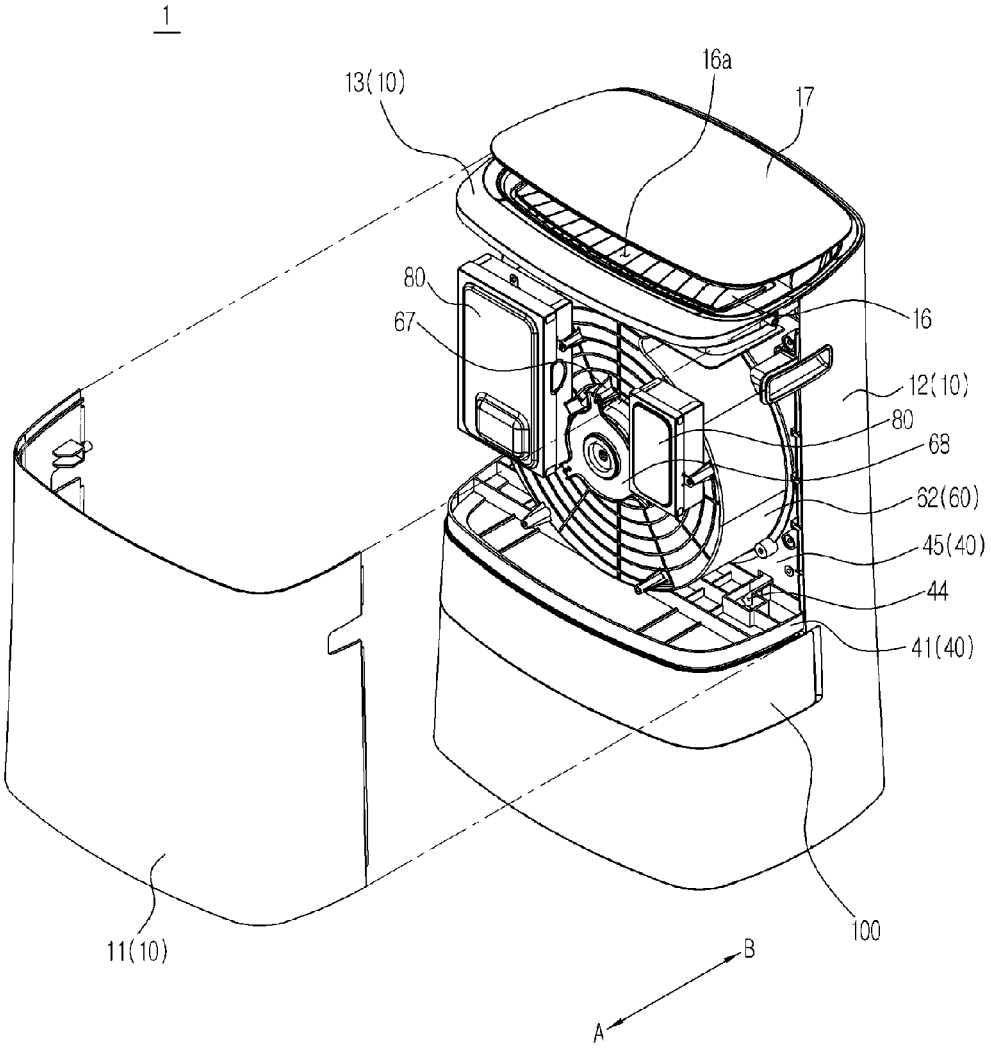
FIG. 4 is a perspective view showing a front part of a dehumidifier according to an embodiment of the present disclosure when a front panel of the dehumidifier is opened.
Figure 6:
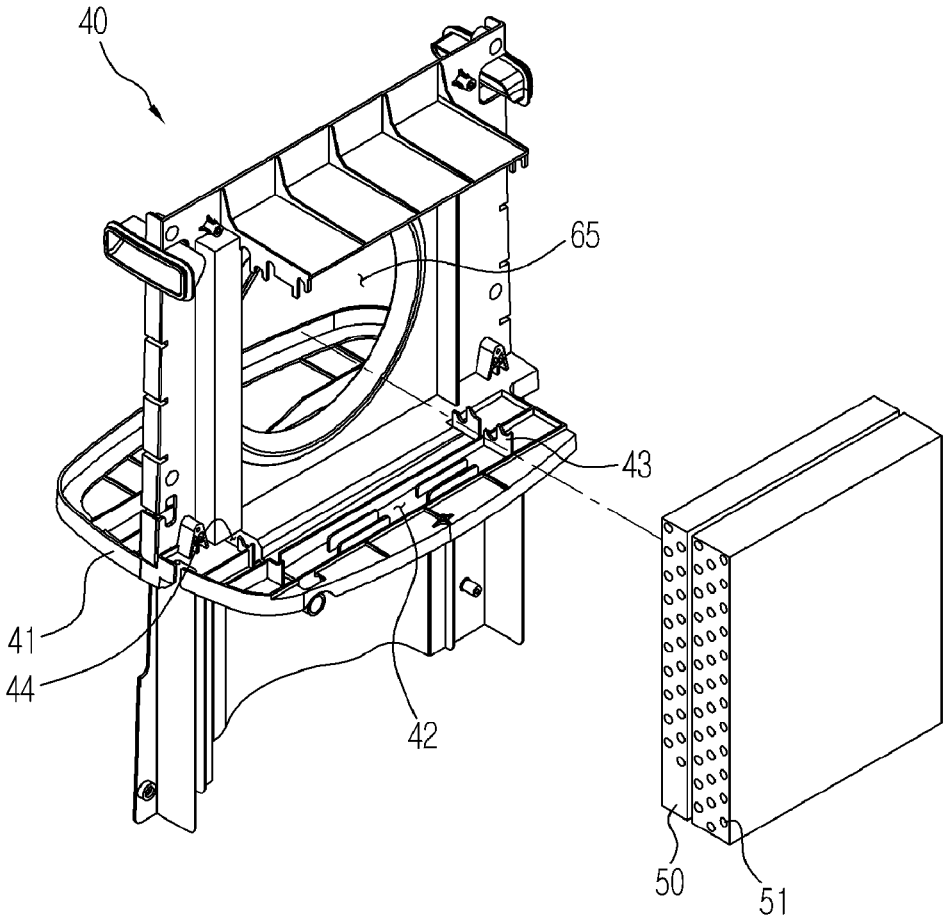
FIG. 6 is a perspective view showing a heat exchanger of a dehumidifier according to an embodiment of the present disclosure.
Figure 7:
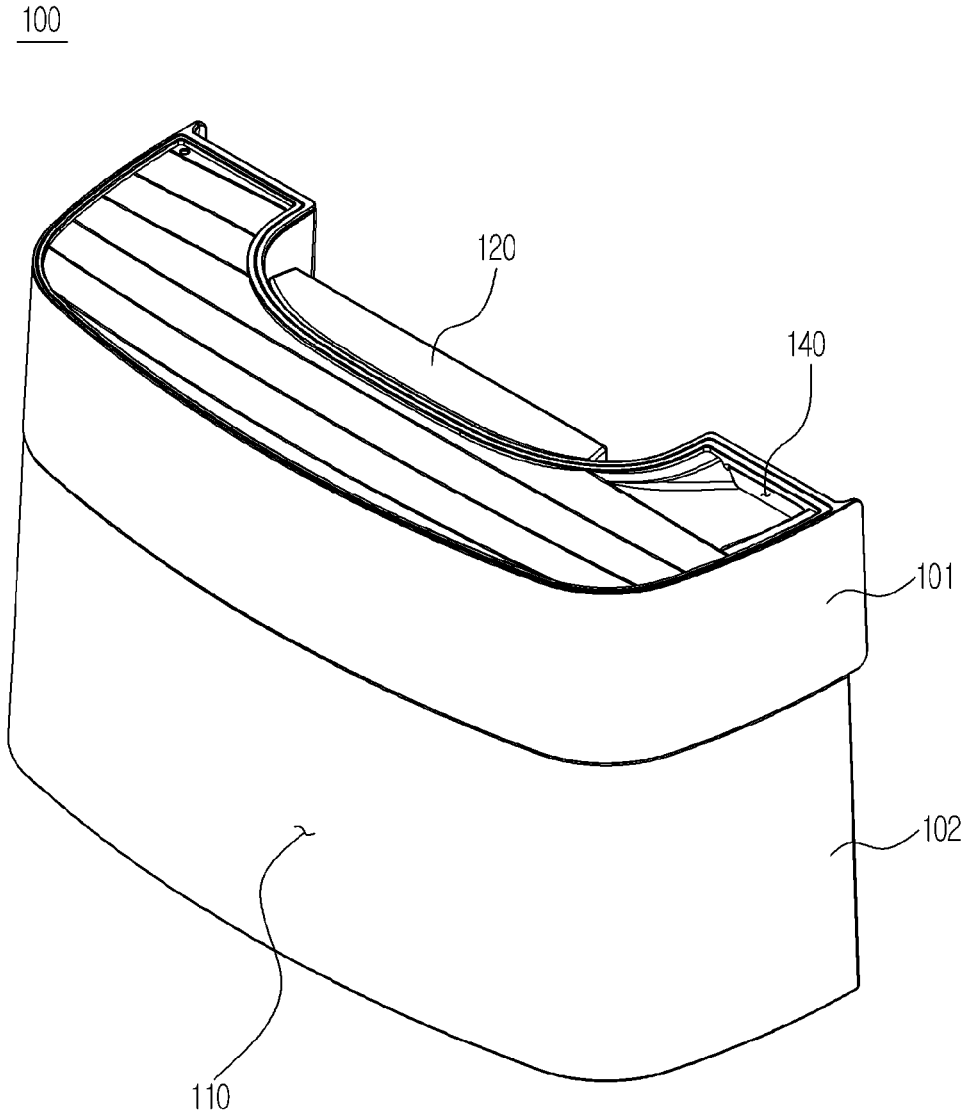
FIG. 7 is a perspective view showing a front part of a water tank of a dehumidifier according to an embodiment of the present disclosure.
Figure 8:
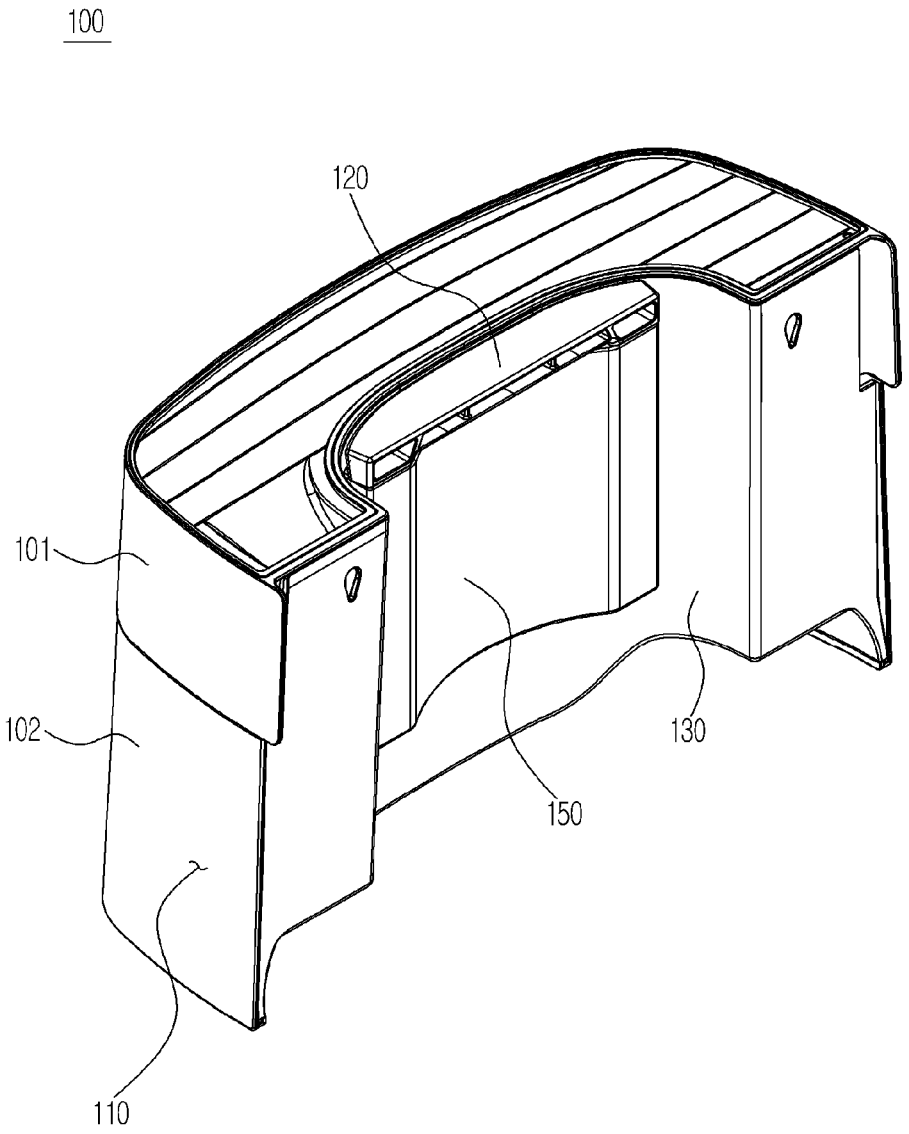
FIG. 8 is a perspective view showing a rear part of a water tank of a dehumidifier according to an embodiment of the present disclosure.
Figure 9:
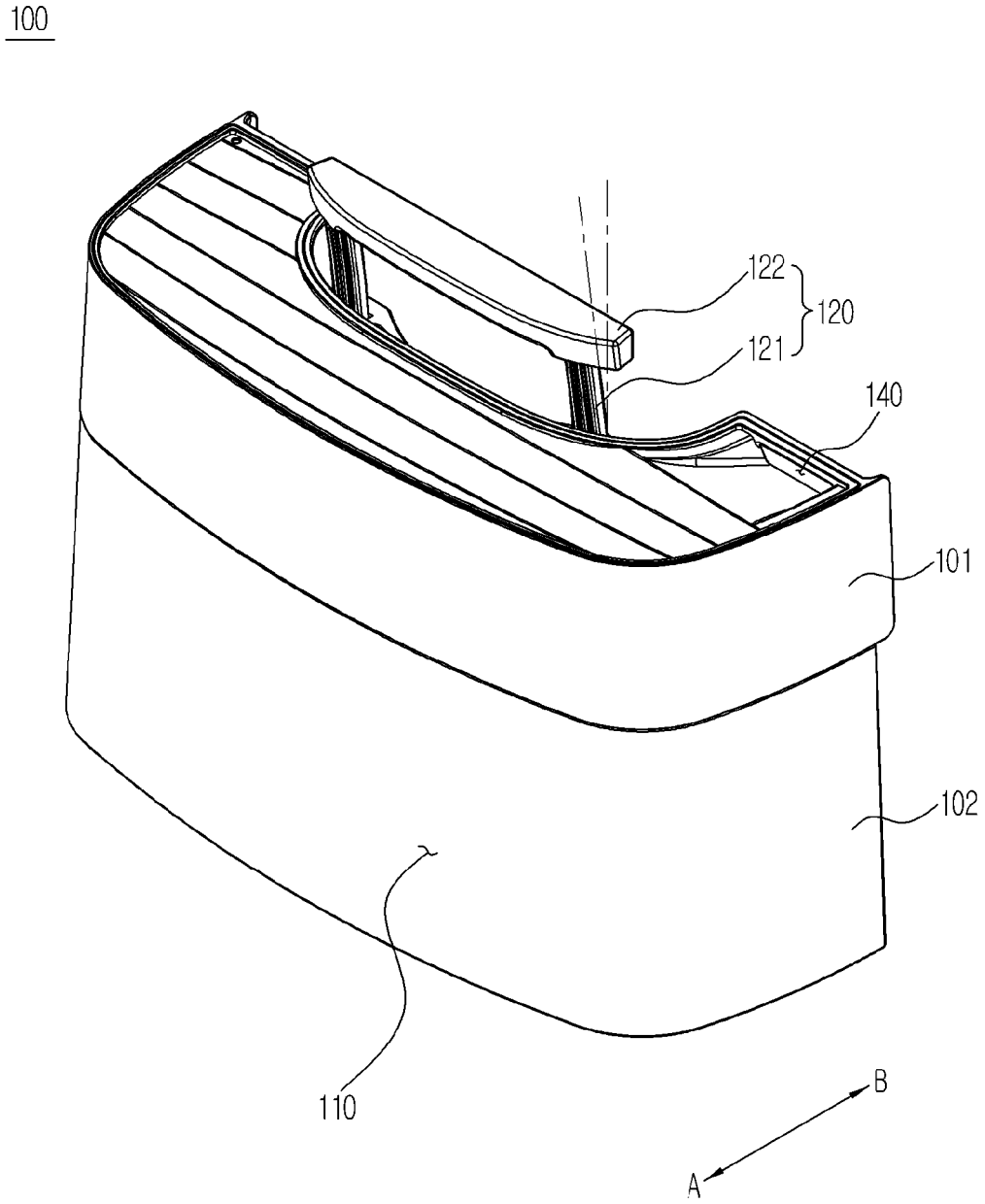
FIG. 9 is an exploded perspective view of a water tank of a dehumidifier according to an embodiment of the present disclosure.

FIG. 3 is a perspective view showing a front part of the dehumidifier 1 according to an embodiment of the present disclosure when the water tank 100 is drawn out. FIG. 4 is a perspective view showing a front part of the dehumidifier 1 according to an embodiment of the present disclosure when the front panel 11 of the dehumidifier 1 is opened. FIG. 5 is an exploded perspective view of the dehumidifier 1 according to an embodiment of the present disclosure. FIG. 6 is a perspective view showing a heat exchanger of the dehumidifier 1 according to an embodiment of the present disclosure. FIG. 7 is a perspective view showing a front part of the water tank 100 of the dehumidifier 1 according to an embodiment of the present disclosure. FIG. 8 is a perspective view showing a rear part of the water tank 100 of the dehumidifier 1 according to an embodiment of the present disclosure, and FIG. 9 is an exploded perspective view of the water tank 100 of the dehumidifier 1 according to an embodiment of the present disclosure.

As shown in FIGS. 3 to 9, the dehumidifier 1 may further include a frame 40, a heat exchanger 50, a blowing assembly 60, and a compressor 70.

The frame 40 may be installed in the main body 10. More specifically, the first panel 11 may be positioned in the first direction A of the frame 40, and the second panel 12 may be positioned in the second direction B of the frame 40. The third panel 13 in which the discharge grille 16 is formed may be coupled to the upper portion of the frame 40, and the fourth panel 14 may be coupled to the lower portion of the frame 40.

The frame 40 may include a plate 41. The heat exchanger 50, which is disposed in the interior of the second panel 12, may be mounted on the plate 41. In detail, the heat exchanger 50 may be rested on a heat exchanger resting portion 42 formed on the plate 41. On the plate 41, a plurality of fixing protrusions 43 spaced away by the length of the heat exchanger 50, protruded upward, and configured to fix the heat exchanger 50 at both edges may be formed.

Air entering the main body 10 through the air entrance 15*a* may exchange heat with refrigerant circulating in the heat exchanger 50. The dehumidifier 1 may include one or more heat exchangers 50. When the dehumidifier 1 includes a plurality of heat exchangers, the heat exchangers may be arranged to face each other. Also, the heat exchangers may have the same size or different sizes. The heat exchanger 50 may include a plurality of ducts 51 including internal passages communicating with each other in order to accelerate heat exchange between air entered the main body 10 through the air entrance 15*a* and refrigerant.

The heat exchanger 50 may function as a compressor and an evaporator, which will be described later.

On the plate 41, a water passageway 44 to guide condensed water formed by heat exchange and condensed on the heat exchanger 50 to the water tank 100 may be formed.

The frame 40 may further include a blowing fan resting portion 45 that is coupled to the upper portion of the plate 41, and a water tank resting portion 46 that is coupled to the lower portion of the plate 41. That is, the plate 41 may partition the frame 40 into the blowing fan resting portion 45 and the water tank resting portion 46.

The blowing assembly 60 may function to expel air entered the main body 10 through the air entrance 15*a* through the air exit 16*a*. The blowing assembly 60 may include a blowing fan 61, a blowing fan housing 62, and a blowing motor 63.

The blowing fan 61 may rotate such that air is sucked in the air entrance 15*a* and expelled through the air exit 16*a*. The blowing fan housing 62 may receive the blowing fan 61 and support it. The blowing motor 63 may provide rotation power to the blowing fan 61 so that the blowing fan 61 can rotate.

The blowing fan housing 62 may be coupled to the blowing fan resting portion 45 facing the first direction A to face the inner side of the first panel 11. The blowing fan 61 received in the blowing fan housing 62 may be inserted into a resting hole 65 formed in the blowing fan resting portion 45.

The blowing motor 63 may be rested on a motor resting portion 66 formed in the first direction A in the blowing fan housing 62. The blowing fan 61 received in the blowing fan housing 62 may rotate with respect to a motor shaft 64 connected to the blowing motor 63. On the blowing fan housing 62, a plurality of coupling parts 67 arranged along the motor resting portion 66 and protruded in the first direction A may be formed. The blowing motor 63 may be fixed on the motor resting portion 66 by a motor mount 68 that is coupled to the plurality of coupling units 67.

The blowing fan housing 62 may be coupled to the blowing fan resting portion 45 to form a discharge passageway 69*a*. The discharge passageway 69*a* may be formed at a location corresponding to the discharge grille 16 formed in the third panel 13. In detail, a guide duct 69 formed in the upper portion of the blowing fan housing 62 may be connected to the discharge grille 16 to form the discharge passageway 69*a*. The guide duct 69 may be integrated into the blowing fan housing 62. Accordingly, air entering the main body 10 through the air entrance 15*a* may move along the discharge passageway 69*a* via the heat exchanger 50, and then be expelled through the air exit 16*a*.

The compressor 70 to compress refrigerant circulating in the heat exchanger 50 may be mounted on a compressor receiving portion 71 formed in the fourth panel 14. The compressor 70 may be disposed below the plate 41 so that the compressor 70 is positioned below the heat exchanger 50. Also, the compressor 70 may be disposed in the interior of the second panel 12 such that the compressor 70 faces the water tank 100 coupled to the water tank resting portion 46 with the water tank resting portion 46 in between.

The dehumidifier 1 may further include an expansion valve (not shown) to decompress and expand refrigerant passed through the heat exchanger 50.

Refrigerant may be compressed by the compressor 70. Refrigerant passed through the compressor 70 may be transferred to the heat exchanger 50 that functions as a condenser, cooled by air entered the main body 10, and condensed. Refrigerant passed through the heat exchanger 50 functioning as a condenser may be transferred to the expansion valve, and then decompressed and expanded. The decompressed, expanded refrigerant may absorb heat from the air entered the main body 10 and thus evaporate in the heat exchanger 50 functioning as an evaporator. During heat exchange between the refrigerant and the air entered the main body 10, condensed water may be formed on the heat exchanger 50, and the condensed water may move along the water passageway 44 formed on the plate 41 and be stored in the water tank 100.

The dehumidifier 1 may further include one or more control boxes 80.

The control boxes 80 may be disposed in the interior of the first panel 11. The control boxes 80 may be mounted on the blowing fan housing 62 to face the inner side of the first panel 11. Each control box 80 may include a plurality of components such as a circuit board to control overall operations of the dehumidifier 1 through manipulation of the manipulation buttons provided on the first panel 11.

The water tank 100 may be detachably attached to the water tank resting portion 46 in order to store condensed water formed during heat exchange between air entered through the air entrance 15*a* and refrigerant.

The water tank resting portion 46 may be coupled to the fourth panel 14. If the water tank 100 may be attached to the water tank resting portion 46, the water tank 100 may be positioned between the plate 41 and the fourth panel 14. The water tank 100 attached to the water tank resting portion 46 may be rested on a recess portion 14*a* formed in the fourth panel 14, wherein the shape of the recess portion 14*a* corresponds to the bottom shape of the water tank 100. The water tank 100 attached to the water tank resting portion 46 and rested on the recess portion 14*a* forms the external appearance of the dehumidifier 1 facing the first direction A, together with the first panel 11 that is coupled to the upper part of the plate 41. The water tank resting portion 46 may be exposed to the outside in the first direction A, when the water tank 100 is detached from the water tank resting portion 46.

The water tank 100 may include a storage space 110 and a handle 120.

Condensed water may be stored in the storage space 110 formed in the water tank 100. In the upper portion of the water tank 100 that faces the lower side of the plate 41 when the water tank 100 is attached to the water tank resting portion 46, an inlet opening 140 may be formed so that condensed water transferred from the heat exchanger 50 along the water passageway 44 formed on the plate 41 is collected in the storage space 110. However, the location of the inlet opening 140 is not limited to the upper portion of the water tank 100. Also, the inlet opening 140 may be in the shape of a hole or slit, however, the shape of the inlet opening 140 is also not limited to these.

The handle 120 may be coupled to the water tank 100 in order for a user to easily carry the water tank 100 detached from the water tank resting portion 46. Also, the handle 120 may be coupled to the outer part of the water tank 100.

More specifically, the handle 120 may be coupled to the outer part of the water tank 100 in such a manner to be able to slide with respect to the outer part of the water tank 100.

The handle 120 may be coupled to the outer part of the water tank 100 in such a manner to be able to rotate with respect to the outer part of the water tank 100.

Hereinafter, for convenience of description, the humidifier 1 is assumed to have a structure in which the handle 120 is coupled to the outer part of the water tank 100 in such a manner to be able to slide with respect to the outer part of the water tank 100.

The handle 120 may be inclined with respect to the outer part of the water tank 100.

The handle 120 may be coupled to one side of the water tank 100, and inclined toward the other side of the water tank 100. More specifically, the handle 120 may be coupled to a handle coupling portion 130 of the water tank 100 that faces the water tank resting portion 46 such that the handle 120 is inclined upward in the first direction A. That is, the handle 120 may be coupled to the handle coupling portion 130 of the water tank 100 in the state of being inclined toward the center of the water tank 100, such that one end of the handle 120 is located on an extension line of the center of gravity of the water tank 100. This will prevent condensed water stored in the storage space 110 from spilling out due to inclination of the water tank 100 caused by the weight of the condensed water, in the case in which the handle 120 is coupled to one side of the water tank 100.

The handle coupling portion 130 may have a curved surface which is convex in the first direction A.

On the handle coupling portion 130 of the water tank 100, one or more guides 131 extending in an up-down direction may be formed. The guides 131 may be protruded in the second direction B. The height of each guide 131 in the second direction B may change in the up-down direction. More specifically, the protrusion height of each guide 131 may be lower at the upper portion.

The handle 120 may include one or more supporting units 121 and a holding unit 122.

The supporting units 121 may slide in the up-down direction along the guides 131.

The holding unit 122 may be connected to the upper ends of the supporting units 121 so that a user can grip the holding unit 122.

The number of the supporting units 121 corresponds to the number of the guides 131. For example, if two guides 131 are formed on the handle coupling portion 130 to be spaced away from each other, the handle 120 may include two supporting units 121 that can slide in the up-down direction along the guides 131. In this case, the holding unit 122 may connect the two supporting units 121.

However, the number of the guides 131 and the supporting units 121 is not limited as long as it is one or more.

On each supporting unit 121, a stopper 123 may be protruded in the first direction A. The stopper 123 may be caught by a catch element 133 formed on the upper end of the corresponding guide 131, and prevent the supporting unit 121 from being separated from or deviating out of the guide 131 when the handle 120 slides in the up direction.

A cover 150 to receive the guides 131 therein may be attached to the handle coupling portion 130 such that the cover 150 faces the water tank resting portion 46.

A portion of the cover 150 facing the water tank resting portion 46 may have a curved surface which is convex in the first direction A, like the handle coupling portion 130.

The cover 150 may be coupled to the guides 131 to form a plurality of engaging holes 151. The supporting units 121 may pass through the engaging holes 151 to slide in the up-down direction along the guides 131.

The holding unit 122 may be caught by the upper plate of the cover 150 protruding in the second direction B to thereby prevent the supporting units 121 from being separated from or deviating out of the guides 131 when the handle 120 slides downward.

The water tank 100 may include a first unit 101 and a second unit 102 that can be separated from each other. The first unit 101 and the second unit 102 may be coupled to form an external appearance of the water tank 100, and form the storage space 110 therein. The first unit 101 wherein the inlet opening 140 is formed in the upper portion may be made of a transparent material so that a user can check the amount of condensed water stored in the storage space 110.

The second unit 102 may also be made of a transparent material.

However, materials of the first and second units 101 and 102 are not limited to transparent materials.

Figure 10:
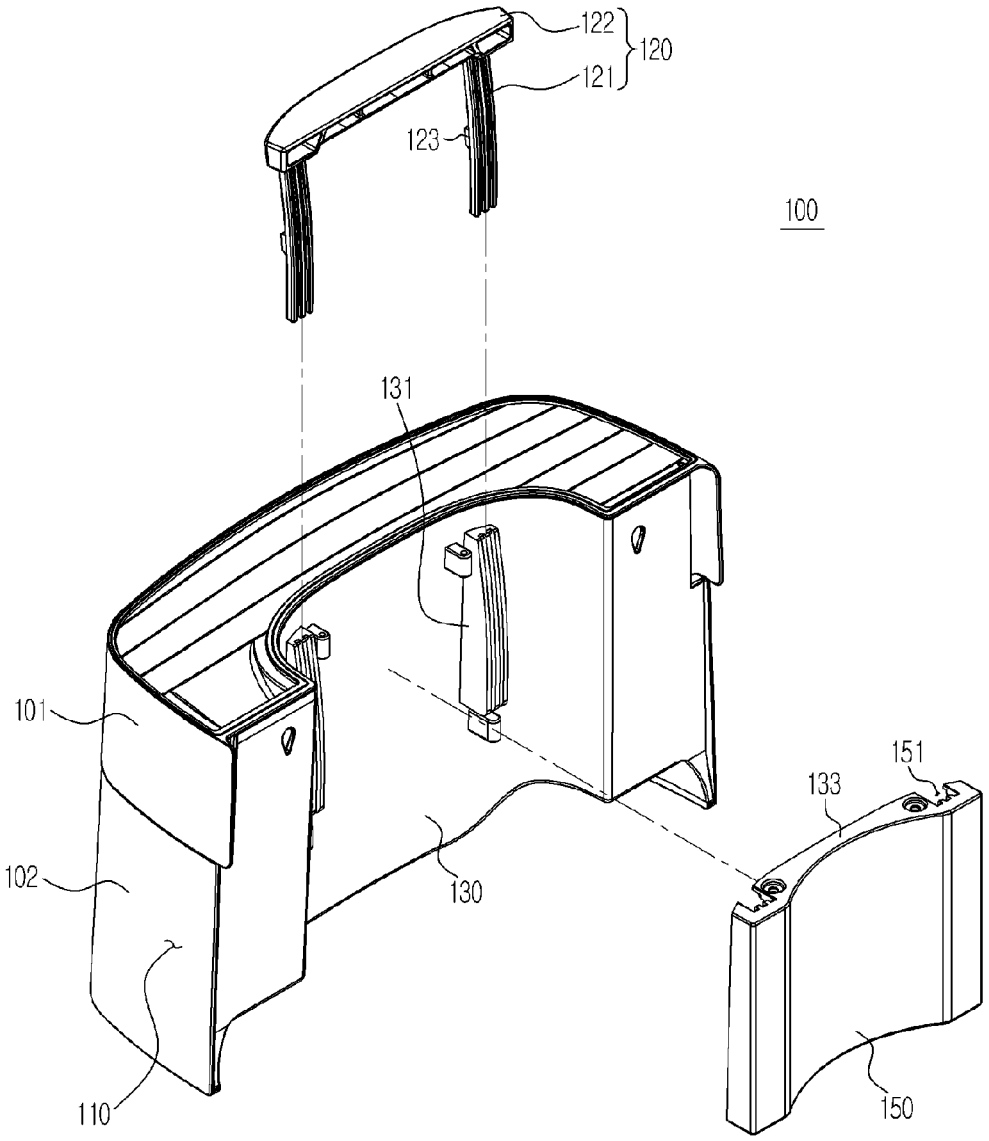
FIG. 10 is a perspective view of a water tank of a dehumidifier according to an embodiment of the present disclosure when a handle of the water tank is drawn out.

FIG. 10 is a perspective view of the water tank 100 of the dehumidifier 1 according to an embodiment of the present disclosure when a handle of the water tank is drawn out.

As shown in FIG. 10, when the water tank 100 is attached to the water tank resting portion 46 to form the external appearance of the dehumidifier 1 facing the first direction A together with the first panel 11, the holding unit 122 of the handle 120 may closely contact the upper plate of the cover 150.

If a user separates the water tank 100 from the water tank resting portion 46, and then grips the holding unit 122 to pull the handle 120 upward, the handle 120 may be inclined in the first direction. Accordingly, condensed water stored in the storage space 110 of the water tank 100 may be prevented from spilling out due to inclination of the water tank 100.

Figure 11:
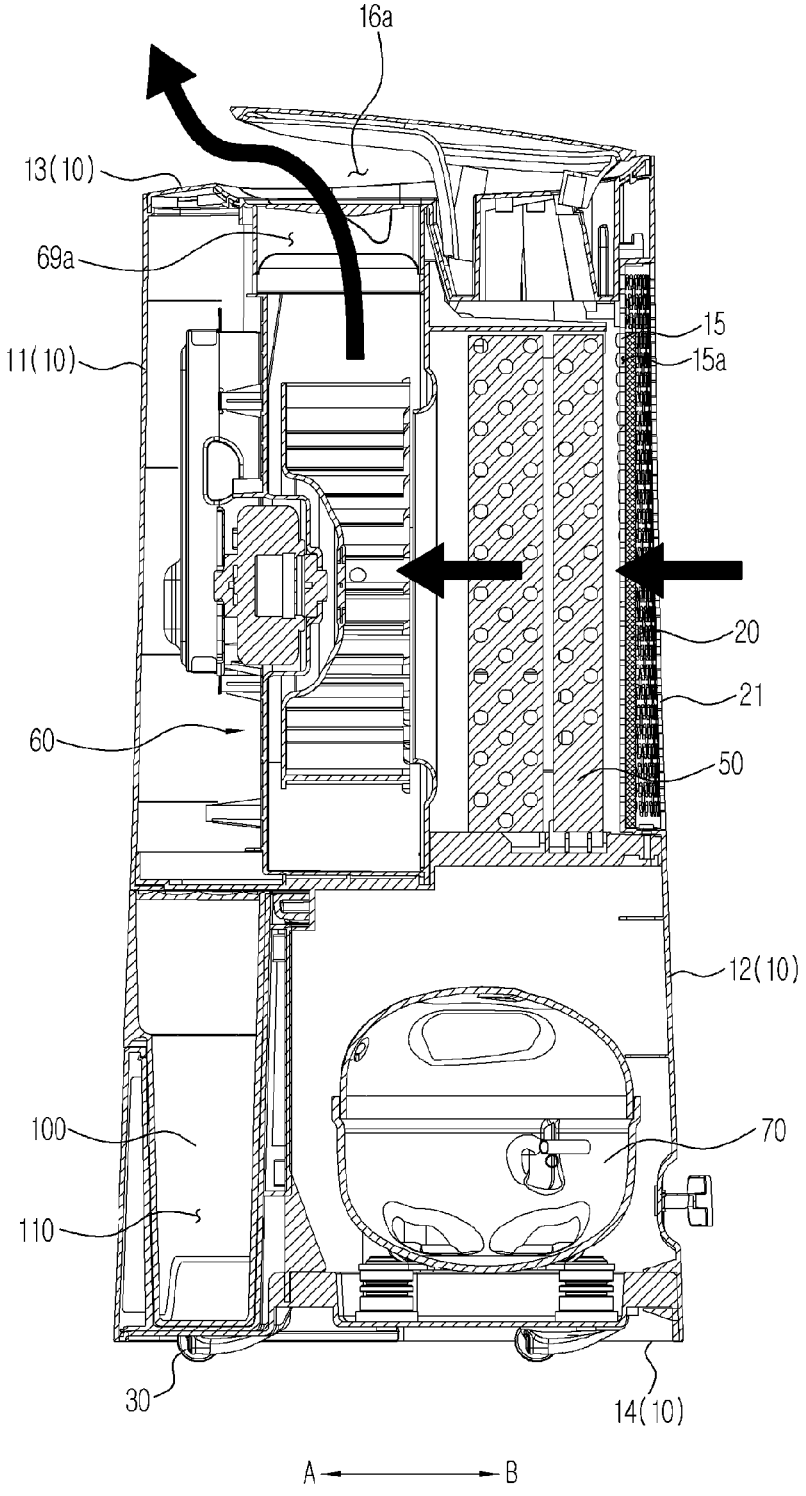
FIG. 11 is a view for describing air flow of a dehumidifier according to an embodiment of the present disclosure.

FIG. 11 is a view for describing air flow of a dehumidifier according to an embodiment of the present disclosure.

As shown in FIG. 11, air flow in the main body 10 proceeds as follows.

If air in the indoor space is conditioned by passing through the filter 20, and then enters the main body 10, the air exchanges heat with refrigerant circulating in the heat exchanger 50. More specifically, air entered the main body 10 may exchange, as described above, heat with refrigerant while passing through the compressor 70, the heat exchanger 50 functioning as a condenser, the expansion valve (not shown), and the heat exchanger 50 functioning as an evaporator, in this order. Thereby, moisture in the air may be formed as condensed water on the heat exchanger 50, and the condensed water may be collected in the storage space 110 of the water tank 100 via the water passageway 44 formed on the plate 41. The dehumidified air may be expelled through the air exit 16*a* via the discharge passageway 69*a*.

As described above, according to the embodiments of the present disclosure, since the handle is located on the outer part of the water tank, a storage space for condensed water in the water tank may increase, and the internal structure of the water tank may be simplified, so that it is easy to maintain cleanliness of the water tank.

Since the handle is coupled to the outer part of the water tank in such a manner to be inclined with respect to the outer part of the water tank, condensed water stored in the water tank may be prevented from spilling out due to inclination of the water tank when the water tank is moved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dehumidifier positionable on a floor, the dehumidifier comprising:

a main body to form an external appearance of the dehumidifier, and including an air entrance and an air exit;

a heat exchanger in which refrigerant to exchange heat with air coming through the air entrance circulates; and a water tank configured to store condensed water formed when the air coming through the air entrance exchanges heat with the refrigerant, wherein the water tank comprises:

a storage space formed in the water tank to store the condensed water, and a handle coupled to the water tank at a first vertical side of the water tank, and inclined toward a second vertical side of the water tank opposite the first vertical side, wherein the first vertical side and the second vertical side are vertical to the floor when the dehumidifier is positioned on the floor, and wherein the handle is configured to slide in an up-down direction.

2. The dehumidifier according to claim 1, wherein the handle is coupled to an outer part of the water tank.

3. The dehumidifier according to claim 1, wherein the water tank is coupled to the main body to face a first direction, and the handle is inclined upward in the first direction with respect to the water tank.

4. The dehumidifier according to claim 3, wherein the main body comprises:

a first panel to form an external appearance of the dehumidifier facing the first direction, together with the water tank; and a second panel including the air entrance, and facing a second direction, and wherein a frame is disposed between the first panel and the second panel, and the water tank is coupled to the frame to face the first direction.

5. The dehumidifier according to claim 4, wherein the water tank is detachably coupled to the frame.

6. The dehumidifier according to claim 4, wherein the main body further comprises a third panel coupled to an upper portion of the frame, and including the air exit, and wherein the third panel is coupled to a discharge louver configured to open or close the air exit.

7. The dehumidifier according to claim 4, wherein the frame includes a water tank resting portion exposed to the first vertical side of the water tank to face the first direction such that the water tank is coupled to the water tank resting portion.

8. The dehumidifier according to claim 7, wherein the heat exchanger is disposed in an interior of the second panel, and the frame further includes a plate positioned over the water tank resting portion such that the heat exchanger is mounted on the plate.

9. The dehumidifier according to claim 8, wherein the plate includes a water passageway formed on the plate, and configured to guide the condensed water formed on the heat exchanger to the storage space.

10. The dehumidifier according to claim 9, wherein the water tank includes an inlet opening formed in a part of the water tank facing the plate, and configured to cause the condensed water moving along the water passageway to be collected in the storage space.

11. The dehumidifier according to claim 7, wherein the handle is coupled to a handle coupling portion on the first vertical side of the water tank which faces the water tank resting portion and the handle is configured to rotate with respect to first vertical side of the water tank while the handle slides in the up-down direction.

12. The dehumidifier according to claim 11, wherein the handle coupling portion includes one or more guides extending in the up-down direction that are formed on the first vertical side of the water tank, and the guides are protruded in the second direction.

13. The dehumidifier according to claim 12, wherein a protrusion height of each guide is lower at an upper portion of the guide.

14. The dehumidifier according to claim 13, wherein the handle comprises:

a holding unit configured to be grippable by a user; and one or more supporting units connected to the holding unit, and configured to slide in the up-down direction along the guides.

15. The dehumidifier according to claim 14, wherein on each supporting unit, a stopper is protruded in the first direction, and wherein the stopper is caught by a catch element formed on an upper end of the corresponding guide in order to prevent the supporting unit from being separated from the guide from an upper portion of the supporting unit.

16. The dehumidifier according to claim 11, wherein the handle coupling portion has a curved surface which is convex in the first direction.

17. A dehumidifier positionable on a floor, the dehumidifier comprising:

a main body including an air entrance and an air exit;

a blowing fan installed in the main body, and configured to blow air coming through the air entrance in a first direction to the air exit;

a heat exchanger configured to exchange heat with air entered the main body by the blowing fan; and a water tank configured to store condensed water formed by the heat exchanger during heat-exchange, and to form an external appearance of the dehumidifier facing the first direction, together with the main body, wherein a handle is coupled to a vertical side of the water tank in such a manner to be inclined upward in the first direction with respect to the water tank, wherein the vertical side is vertical to the floor when the dehumidifier is positioned on the floor, and wherein handle is configured to slide in an up-down direction.

18. The dehumidifier according to claim 17, wherein the handle is coupled to an outer part of the vertical side of the water tank and the handle is configured to rotate with respect to the outer part of the vertical side of the water tank while the handle slides in the up-down direction.

19. The dehumidifier according to claim 17, wherein the handle is coupled to an outer part of the vertical side of the water tank.

20. The dehumidifier according to claim 17, wherein the main body comprises:

a first panel positioned in a up-down direction with respect to the water tank to face the first direction; and a second panel including the air entrance, and facing a second direction that is opposite to the first direction, wherein a frame is disposed between the first panel and the second panel, and the water tank is detachably coupled to the frame.

21. The dehumidifier according to claim 20, wherein the frame comprises:

a water tank resting portion with which a handle coupling portion on the vertical side of the water tank including a curved surface which is convex in the first direction is coupled;

a blowing fan resting portion located in a up-down direction with respect to the water tank resting portion, and coupled to the blowing fan; and a plate disposed between the water tank resting portion and the blowing fan resting portion such that the heat exchanger disposed in an interior of the second panel is mounted on the plate.

22. The dehumidifier according to claim 21, wherein the plate includes a water passageway formed on the plate, and configured to guide the condensed water to an interior of the water tank in order to store the condensed water in the water tank.

23. The dehumidifier according to claim 21, wherein the handle coupling portion includes a plurality of guides formed on the vertical side of the water tank, extending in a up-down direction and protruding in the second direction, and wherein the plurality of guides are spaced away from each other, and a protrusion height of each guide is higher at a lower portion of the guide.

24. The dehumidifier according to claim 23, wherein the handle comprises:

a plurality of supporting units configured to slide in a up-down direction along the plurality of guides; and a holding unit connecting the plurality of supporting units to each other, and configured to be grippable by a user.

25. The dehumidifier according to claim 24, wherein the handle coupling portion includes a cover attached to the vertical side of the water tank to face the water tank resting portion, and wherein the cover is coupled to the plurality of guides to form a plurality of engaging holes through which the plurality of supporting units pass to slide in the up-down direction.

26. The dehumidifier according to claim 25, wherein the holding unit is caught by an upper plate of the cover in order to prevent the plurality of supporting units from being separated from the plurality of guides from lower portions of the supporting units.

27. A dehumidifier positionable on a floor, the dehumidifier comprising:

a main body including an air entrance and an air exit; and a water tank configured to store moisture in air entering the main body, and coupled to the main body to form an external appearance of the dehumidifier, wherein a handle is coupled to an outer part of a vertical side of the water tank in such a manner as to be inclined with respect to the outer part of the vertical side of the water tank, wherein the vertical side is vertical to the floor when the dehumidifier is positioned on the floor, and wherein the handle is configured to slide in an up-down direction.

* * * * *